US006621377B2

(12) United States Patent
Osadchy et al.

(10) Patent No.: US 6,621,377 B2
(45) Date of Patent: Sep. 16, 2003

(54) MICROSTRIP PHASE SHIFTER

(75) Inventors: Vitaly Osadchy, Leningradskaia obl. (RU); Cornelis F. DuToit, Ellicott, MD (US); Louise C. Sengupta, Ellicott, MD (US); Andrey Kozyrev, St. Petersburg (RU)

(73) Assignee: Paratek Microwave, Inc., Columbia, MD (US)

( * ) Notice: Subject to any disclaimer, the term of this patent is extended or adjusted under 35 U.S.C. 154(b) by 0 days.

(21) Appl. No.: 09/847,254

(22) Filed: May 2, 2001

(65) Prior Publication Data

US 2002/0014932 A1 Feb. 7, 2002

Related U.S. Application Data

(60) Provisional application No. 60/201,203, filed on May 2, 2000.

(51) Int. Cl.[7] ..... H01P 1/18
(52) U.S. Cl. ..... 333/161; 333/156
(58) Field of Search ..... 333/995, 156, 333/161, 205

(56) References Cited

U.S. PATENT DOCUMENTS

| | | | |
|---|---|---|---|
| 5,032,805 | A | 7/1991 | Elmer et al. |
| 5,079,557 | A | 1/1992 | Hopwood et al. |
| 5,212,463 | A | 5/1993 | Babbitt et al. |
| 5,218,358 | A | 6/1993 | Harrington et al. |
| 5,307,033 | A | 4/1994 | Koscica et al. |
| 5,312,790 | A | 5/1994 | Sengupta et al. |
| 5,427,988 | A | 6/1995 | Sengupta et al. |
| 5,451,567 | A | 9/1995 | Das |
| 5,472,935 | A | 12/1995 | Yandrofski et al. |
| 5,479,139 | A | 12/1995 | Koscica et al. |
| 5,486,491 | A | 1/1996 | Sengupta et al. |
| 5,557,286 | A | 9/1996 | Varadan et al. |
| 5,561,407 | A | 10/1996 | Koscica et al. |
| 5,589,845 | A | 12/1996 | Yandrofski et al. |
| 5,604,375 | A | 2/1997 | Findikoglu et al. |
| 5,617,103 | A | 4/1997 | Koscica et al. |

(List continued on next page.)

FOREIGN PATENT DOCUMENTS

| | | |
|---|---|---|
| WO | WO 00/24079 | 4/2000 |

OTHER PUBLICATIONS

U.S. patent application Ser. No. 09/594,837, Chiu, filed Jun. 15, 2000.
U.S. patent application Ser. No. 09/768,690, Sengupta et al., filed Jan. 24, 2001.

(List continued on next page.)

*Primary Examiner*—Seungsook Ham
(74) *Attorney, Agent, or Firm*—Robert P. Lenart; James S. Finn; William J. Tucker

(57) ABSTRACT

A phase shifter includes a substrate, a first electrode positioned on a surface of the substrate, a tunable dielectric layer positioned on a surface of the electrode, a microstrip positioned on a surface of the tunable dielectric layer opposite the substrate, an input for coupling a radio frequency signal to the microstrip, an output for receiving the radio frequency signal from the microstrip, and a connection for applying a control voltage to the electrode. In an alternative embodiment, a second electrode can be positioned on the surface of the substrate and separated from the first electrode to form a gap positioned under the microstrip.

8 Claims, 3 Drawing Sheets

U.S. PATENT DOCUMENTS

| | | | | |
|---|---|---|---|---|
| 5,635,433 | A | | 6/1997 | Sengupta |
| 5,635,434 | A | | 6/1997 | Sengupta |
| 5,679,624 | A | * | 10/1997 | Das ..... 333/161 |
| 5,693,429 | A | | 12/1997 | Sengupta et al. |
| 5,766,697 | A | | 6/1998 | Sengupta et al. |
| 5,830,591 | A | | 11/1998 | Sengupta et al. |
| 5,846,893 | A | | 12/1998 | Sengupta et al. |
| 5,917,455 | A | | 6/1999 | Huynh et al. |
| 5,940,030 | A | | 8/1999 | Hampel et al. |
| 5,965,494 | A | * | 10/1999 | Terashima et al. ..... 333/219 |
| 6,078,827 | A | | 6/2000 | Jackson |
| 6,329,959 | B1 | * | 12/2001 | Varadan et al. ..... 343/700 MS |

OTHER PUBLICATIONS

A. Burgel et al, "Optical Second–Harmonic Generation at Interfaces of Ferroelectric Nanoregions in SrSiO/Sub 3/;Ca sic. SrTiO/Sub 3/:Ca," *Physical Review B* (*Condensed Matter*), vol. 53, Mar. 1, 1996, Abstract only.

K. Murakami et al, "Effects of Adding Various Metal Oxides on Low–Temperature Sintered Pb(Zr, Ti)$O_3$ Ceramics," *Japan Journal of Applied Physics*, vol. 35, Part 1, No. 9B, Sep. 1996, pp. 5188–5191.

F. De Flaviis et al, "Planar Microwave Integrated Phase–Shifter Design with High Purity Ferroelectric Material," *IEEE, Theory and Techniques*, vol. 45, No. 6, Jun. 1997, pp. 963–969.

* cited by examiner

MICROSTRIP PHASE SHIFTER

CROSS REFERENCE TO RELATED APPLICATION

This application claims the benefit of the filing date of provisional application Serial No. 60/201,203, filed May 2, 2000.

FIELD OF THE INVENTION

This invention relates to electronic phase shifters, and more particularly, to voltage-tunable dielectric microstrip phase shifters.

BACKGROUND OF INVENTION

Prior to 1950, most phase shifters were mechanical. Electronic phase shifters became more important thereafter with the need for a steerable antenna beam (phased array antenna technology), especially for military applications. Lately, this has also become important in commercial telecommunications, i.e. satellite communications, and smart antenna technology for mobile telephony. Electronic phase shifters come in two varieties: continuously adjustable phase shifters and discrete stepped phase shifters. The latter usually employ pin diodes or low power transistors such as MESFETs as electronic switches. The former can be constructed using various technologies, including: (1) the use of tunable dielectric materials such as ferrites or ferroelectrics, etc.; (2) GaAs active phase shifters; (3) magnetostatic wave time delay phase shifters; and (4) MMIC phase shifters employing MESFETs and varactors.

Tunable phase shifters using ferroelectric materials are disclosed in U.S. Pat. Nos. 5,307,033, 5,032,805, and 5,561,407. These phase shifters include a ferroelectric substrate as the phase modulating element. The permittivity of the ferroelectric substrate can be changed by varying the strength of an electric field applied to the substrate. Tuning of the permittivity of the substrate results in phase shifting when an RF signal passes through the phase shifter. The ferroelectric phase shifters disclosed in those patents exhibit high conductor losses, high modes, high DC bias voltages, and impedance matching problems at K and Ka bands.

One known type of phase shifter is the microstrip line phase shifter. Examples of microstrip line phase shifters utilizing tunable dielectric materials are shown in U.S. Pat. Nos. 5,212,463; 5,451,567 and 5,479,139. These patents disclose microstrip lines loaded with a voltage tunable ferroelectric material to change the velocity of propagation of a guided electromagnetic wave.

Tunable ferroelectric materials are materials whose permittivity (more commonly called dielectric constant) can be varied by varying the strength of an electric field to which the materials are subjected. Even though these materials work in their paraelectric phase above the Curie temperature, they are conveniently called "ferroelectric" because they exhibit spontaneous polarization at temperatures below the Curie temperature. Tunable ferroelectric materials including barium-strontium titanate (BST) or BST composites have been the subject of several patents.

Dielectric materials including barium strontium titanate are disclosed in U.S. Pat. No. 5,312,790 to Sengupta, et al. entitled "Ceramic Ferroelectric Material"; U.S. Pat. No. 5,427,988 to Sengupta, et al. entitled "Ceramic Ferroelectric Composite Material—BSTO—MgO"; U.S. Pat. No. 5,486,491 to Sengupta, et al. entitled "Ceramic Ferroelectric Composite Material—BSTO—$ZrO_2$"; U.S. Pat. No. 5,635,434 to Sengupta, et al. entitled "Ceramic Ferroelectric Composite Material—BSTO—Magnesium Based Compound"; U.S. Pat. No. 5,830,591 to Sengupta, et al. entitled "Multilayered Ferroelectric Composite Waveguides"; U.S. Pat. No. 5,846,893 to Sengupta, et al. entitled "Thin Film Ferroelectric Composites and Method of Making"; U.S. Pat. No. 5,766,697 to Sengupta, et al. entitled "Method of Making Thin Film Composites"; U.S. Pat. No. 5,693,429 to Sengupta, et al. entitled "Electronically Graded Multilayer Ferroelectric Composites"; and U.S. Pat. No. 5,635,433 to Sengupta, entitled "Ceramic Ferroelectric Composite Material—BSTO—ZnO". These patents are hereby incorporated by reference. Copending, commonly assigned U.S. patent applications Ser. No. 09/594,837, filed Jun. 15, 2000, and Ser. No. 09/768,690, filed Jan. 24, 2001, disclose additional tunable dielectric materials and are also incorporated by reference. The materials shown in these patents, especially BSTO—MgO composites, exhibit low dielectric loss and high tunability. Tunability is defined as the fractional change in the dielectric constant with applied voltage.

Adjustable phase shifters are used in many electronic applications, such as for beam steering in phased array antennas. A phased array refers to an antenna configuration composed of a large number of elements that emit phased signals to form a radio beam. The radio signal can be electronically steered by the active manipulation of the relative phasing of the individual antenna elements. Phase shifters play a key role in operation of phased array antennas. The electronic beam steering concept applies to antennas used with both transmitters and receivers. Phased array antennas are advantageous in comparison to their mechanical counterparts with respect to speed, accuracy, and reliability. The replacement of gimbals in mechanically scanned antennas with electronic phase shifters in electronically scanned antennas increases the survivability of antennas used in defense systems through more rapid and accurate target identification. Complex tracking exercises can also be performed rapidly and accurately with a phased array antenna system.

U.S. Pat. No. 5,617,103 discloses a ferroelectric phase shifting antenna array that utilizes ferroelectric phase shifting components. The antennas disclosed in that patent utilize a structure in which a ferroelectric phase shifter is integrated on a single substrate with plural patch antennas. Additional examples of phased array antennas that employ electronic phase shifters can be found in U.S. Pat. Nos. 5,079,557; 5,218,358; 5,557,286; 5,589,845; 5,617,103; 5,917,455; and 5,940,030.

U.S. Pat. Nos. 5,472,935 and 6,078,827 disclose coplanar waveguides in which conductors of high temperature superconducting material are mounted on a tunable dielectric material. The use of such devices requires cooling to a relatively low temperature. In addition, U.S. Pat. Nos. 5,472,935 and 6,078,827 teach the use of tunable films of $SrTiO_3$, or $(Ba, Sr)TiO_3$ with high a ratio of Sr. ST and BST have high dielectric constants, which results in low characteristic impedance. This makes it necessary to transform the low impedance phase shifters to the commonly used 50 ohm impedance.

Low cost phase shifters that can operate at room temperature could significantly improve performance and reduce the cost of phased array antennas. This could play an important role in helping to transform this advanced technology from recent military dominated applications to commercial applications.

There is a need for electrically tunable phase shifters that can operate at room temperatures and at K and Ka band frequencies (18 GHz to 27 GHz and 27 GHz to 40 GHz, respectively), while maintaining high Q factors and having characteristic impedances that are compatible with existing circuits.

SUMMARY OF INVENTION

Phase shifters constructed in accordance with this invention include a substrate, a first electrode positioned on a surface of the substrate, a tunable dielectric layer positioned on a surface of the electrode, a microstrip positioned on a surface of the tunable dielectric layer opposite the substrate, an input for coupling a radio frequency signal to the microstrip, an output for receiving the radio frequency signal from the microstrip, and a connection for applying a control voltage to the electrode. In an alternative embodiment, a second electrode can be positioned on the surface of the substrate and separated from the first electrode to form a gap positioned under the microstrip.

Phase shifters constructed in accordance with this invention operate at room temperature. The phase shifters of the present invention can be used in phased array antennas at wide frequency ranges. The devices utilize low loss tunable dielectric materials.

BRIEF DESCRIPTION OF THE DRAWINGS

A full understanding of the invention can be gained from the following description of the preferred embodiments when read in conjunction with the accompanying drawings in which.

DETAILED DESCRIPTION OF THE PREFERRED EMBODIMENTS

Phase shifters constructed in accordance with this invention use a voltage tunable dielectric layer as part of a composite dielectric for supporting a microstrip. This type of phase shifter is very well suited for a general purpose microwave component in a variety of applications such as radar, microwave instrumentation and measurement systems, and radio frequency phased array antennas. The phase shifter of this invention can be used over a wide frequency range, from 500 MHz to 40 GHz.

This invention uses low loss voltage tunable dielectric material to change the velocity of propagation of a guided electromagnetic wave, thus providing continuously adjustable phase shifters. A unique electrode arrangement for biasing the voltage tunable dielectric material eliminates the need for high voltage DC blocking circuits to prevent the biasing voltage from causing damage to sensitive radio frequency circuits connected to the phase shifter.

Figure 1:
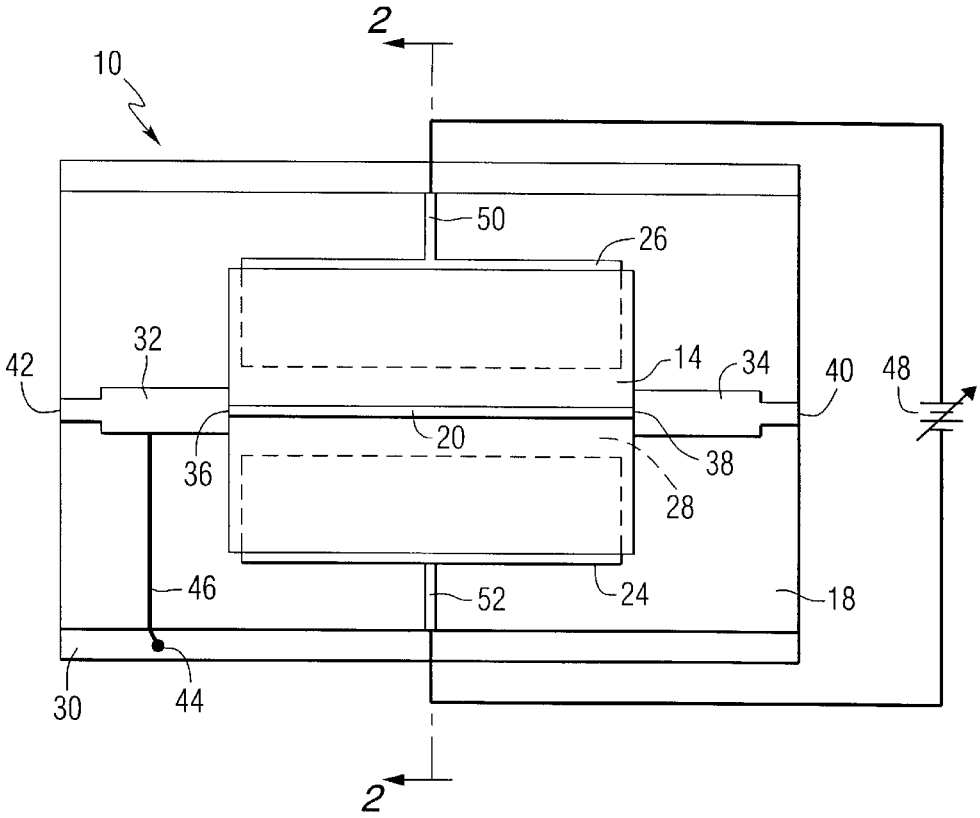
FIG. 1 is a top plan view of a phase shifter constructed in accordance with the present invention.
Figure 2:
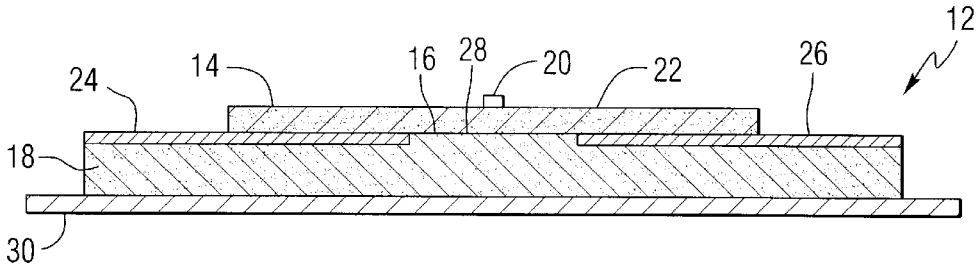
FIG. 2 is a cross-sectional view of the phase shifter of FIG. 1, taken along line 2—2.
Figure 3:
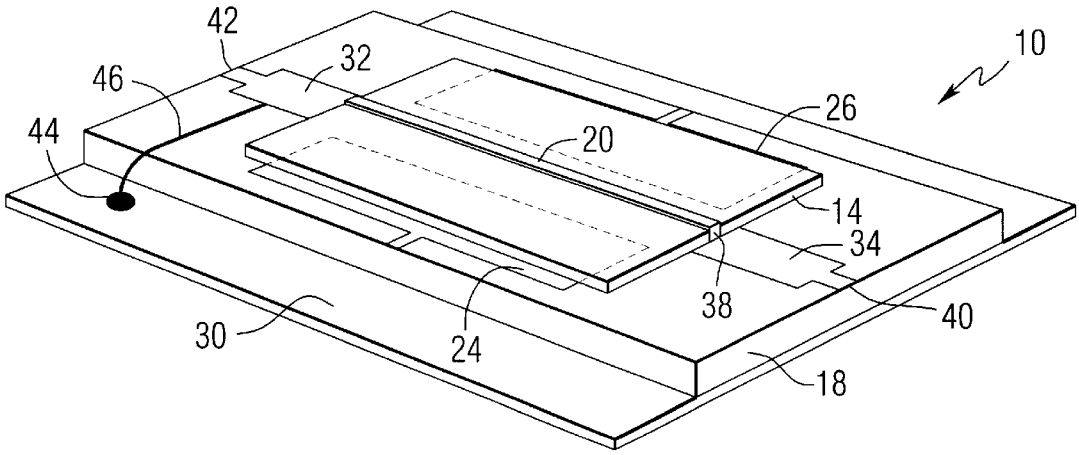
FIG. 3 is an isometric view of the phase shifter of FIG. 1.

Referring to the drawings, FIG. 1 is a top plan view of a two port phase shifter 10 constructed in accordance with the present invention. FIG. 2 is a cross-sectional view of the phase shifter of FIG. 1, taken along line 2—2. FIG. 3 is an isometric view of the phase shifter of FIG. 1. The phase shifter 10 includes a composite substrate 12 comprising a first dielectric material layer 14 positioned adjacent to a surface 16 of a second dielectric layer 18. The first dielectric layer is comprised of a voltage tunable material. The second dielectric layer can be a low loss, conventional non-tunable dielectric layer such as aluminum oxide or magnesium oxide, or it could be a tunable dielectric layer, which can be the same material as the first dielectric layer. A microstrip line 20, preferably made of copper, is positioned on a surface 22 of the first tunable dielectric layer, on a side opposite that of the second dielectric layer. First and second biasing electrodes 24 and 26 are inserted between the first and second dielectric layers and positioned on opposite sides of the microstrip so as to leave a slot 28 wider than the microstrip line itself directly under the microstrip line 20. A ground plane 30, preferably made of copper, is positioned adjacent to the second dielectric layer on a side opposite that of the first dielectric layer.

Matching networks 32 and 34, which could be in the form of microstrip quarter wave transformers, are supported by the second dielectric layer and connected to the microstrip line by steps 36 and 38 at the ends of the first dielectric layer 14. The matching networks couple the microstrip line 20 to input/output ports 40 and 42. While the matching networks are shown to be mounted on the second dielectric layer, it should be understood that they could also be mounted on a third dielectric layer (not shown), that would in turn be mounted on a second ground plane (not shown). The matching networks are electrically connected to the microstrip line 20. If the microstrip line is not DC connected to the ground plane via a DC electric path outside the physical domain of the phase shifter, such as via a microstrip to waveguide adapter, then one of the matching networks should be connected to a DC connection 44 with a radio frequency block 46 to ground. The latter could be in the form of a short-circuited quarter wavelength stub with a very high characteristic impedance, or a highly inductive wire (RF choke) connecting the circuit to the ground plane. The biasing electrodes are supplied with a DC bias voltage from an external voltage source 48 via DC feed lines 50 and 52.

The matching networks ensure that a guided wave entering one port 40 (arbitrarily defined as the input port) will enter the phase shifter and leave it at the other port 42 (output port), with minimum residual reflections at each port. The microstrip and ground plane are kept at zero voltage, while a bias voltage is applied to the electrodes. The voltage bias subjects the voltage tunable dielectric material to a DC electric field, which affects the dielectric permittivity of the material. In this way, the dielectric permittivity of the voltage tunable dielectric material can be controlled by the bias voltage. Since the velocity of the guided wave travelling through the device is inversely proportional to the square root of the effective dielectric permittivity of the material around the strip, the biasing voltage can be used to control the guided wave velocity. Therefore it also controls the amount of phase delay at the output port when referenced to the input port.

The embodiment of FIGS. 1–3 is a wideband device. The bandwidth is only limited by the matching networks, which were depicted for the sake of simplicity as single stage matching transformers. With multi-stage matching networks, an arbitrary bandwidth up to an octave or more can be achieved. The embodiment of FIGS. 1–3 would require a comparatively long length of microstrip line for a certain required amount of phase shift tuning range. This is because of the fact that the microstrip line couples to the ground plane via a composite dielectric, with only one of the layers in the composite being tuned.

Figure 4:
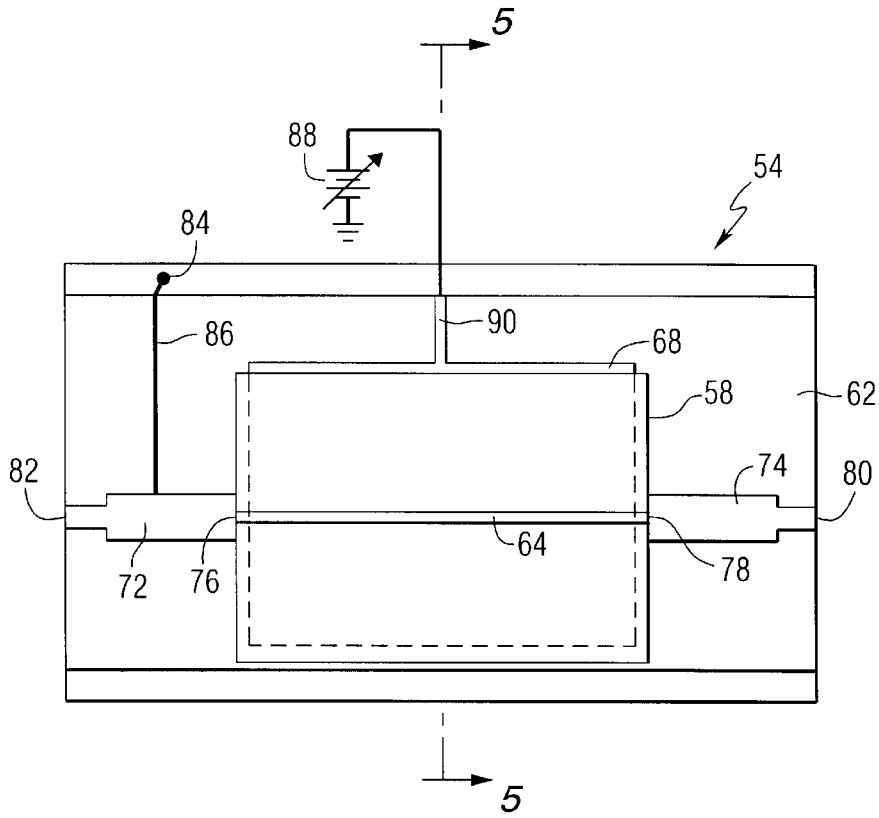
FIG. 4 is a top plan view of another phase shifter constructed in accordance with the present invention.
Figure 5:
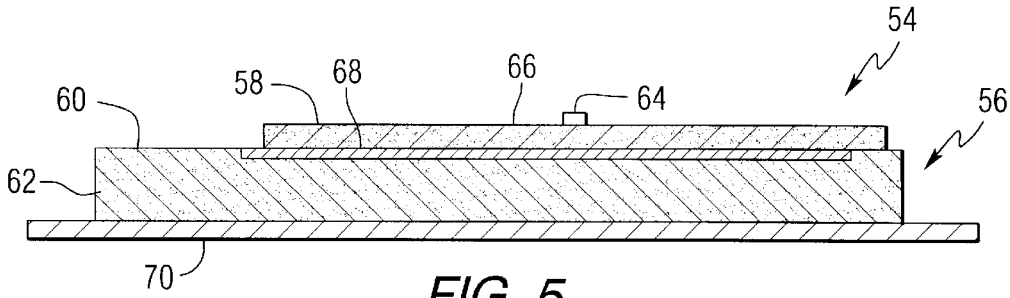
FIG. 5 is a cross-sectional view of the phase shifter of FIG. 4, taken along line 5—5.

FIG. 4 is a top plan view of another phase shifter 54 constructed in accordance with the present invention, and FIG. 5 is a cross-sectional view of the phase shifter of FIG. 4, taken along line 5—5. The phase shifter 54 includes a composite substrate 56 comprising a first dielectric material layer 58 positioned adjacent to a surface 60 of a second dielectric layer 62. The first dielectric layer 58 is comprised of a voltage tunable material. The second dielectric layer 62 can be a low loss, conventional non-tunable dielectric layer such as aluminum oxide or magnesium oxide. A microstrip line 64, preferably made of copper, is positioned on a surface 66 of the first tunable dielectric layer, on a side opposite that of the second dielectric layer. A biasing electrode 68 is inserted between the first and second dielectric layers and positioned directly under the microstrip line to form a "floating" ground plane for the microstrip line. A ground plane 70, preferably made of copper, is positioned adjacent to the second dielectric layer on a side opposite that of the first dielectric layer. To avoid resonance modes in the floating ground plane/biasing electrode 68, it should preferably be an odd multiple of quarter wavelengths long in terms of waves trapped between it and ground plane 70.

Matching networks 72 and 74, which could be in the form of microstrip quarter wave transformers, are supported by the second dielectric layer and connected to the microstrip line by steps 76 and 78 at the ends of the first dielectric layer. The matching networks couple the microstrip line 64 to input/output ports 80 and 82. While the matching networks are shown to be mounted on the second dielectric layer, it should be understood that they could also be mounted on a third dielectric layer (not shown), that is in turn mounted on a second ground plane (not shown). The matching networks are electrically connected to the microstrip. If the microstrip line is not DC connected to the ground plane via a DC electric path outside the physical domain of the phase shifter, such as via a microstrip to waveguide adapter, then one of the matching networks should be connected to a DC connection 84 with a radio frequency block 86 to ground. The latter could be in the form of a short-circuited quarter wavelength stub with a very high characteristic impedance, or a highly inductive wire (RF choke) connecting the circuit to the ground plane. The biasing electrode is supplied with a DC bias voltage from an external DC source 88 via a DC feed line 90.

The embodiment of FIGS. 4–5 is a narrow band device. The bandwidth is limited to an arbitrary range below or between two of the resonance mode frequencies of the floating ground plane. This embodiment requires a comparatively short length of microstrip line for a certain required amount of phase shift tuning range. This is because of the fact that the microstrip line couples to the floating ground plane only via a single tunable dielectric layer.

The tunable dielectric used in the preferred embodiments of phase shifters of this invention has a lower dielectric constant than conventional tunable materials. The dielectric constant can be changed by 20% to 70% at 20 V/$\mu$m, and typically by about 50%. The magnitude of the maximum required bias voltage varies with the distance between then microstrip and the biasing electrode(s), and typically ranges from about 8 to 10 V per $\mu$m. Lower bias voltage levels have many benefits, however, the required bias voltage is dependent on the device structure and materials. The phase shifter in the present invention is designed to have a 360° phase shift. The dielectric constant can range from 70 to 600, and typically ranges from 70 to 150. In the preferred embodiment, the tunable dielectric is a barium strontium titanate (BST) based film having a dielectric constant of about 100 at zero bias voltage. The preferred material will exhibit high tuning and low loss. The preferred embodiments utilize materials with tuning of around 50%, and a loss as low as possible, which is typically in the range of (loss tangent) 0.01 to 0.03 at 24 GHz. More specifically, in the preferred embodiment, the composition of the material is a barium strontium titanate ($Ba_xSr_{1-x}TiO_3$, BSTO, where x is less than 1), or BSTO composites with a dielectric constant of 70 to 600, a tuning range from 20 to 60%, and a loss tangent of 0.008 to 0.03 at K and Ka bands. Examples of such BSTO composites that possess the required performance parameters include, but are not limited to: BSTO—MgO, BSTO—$MgAl_2O_4$, BSTO—$CaTiO_3$, BSTO—$MgTiO_3$, BSTO—$MgSrZrTiO_6$, and combinations thereof.

The K and Ka band microstrip phase shifters of the preferred embodiments of this invention are fabricated on a bulk tunable dielectric layer with a dielectric constant (permittivity) $\in$ of around 70 to 150 at zero bias and a thickness of 100 to 150 $\mu$m. The tunable dielectric layer is attached to a low dielectric constant substrate MgO with thickness of about 0.25 mm. For the purposes of this description a low dielectric constant is less than 25. MgO has a dielectric constant of about 10. However, the low dielectric substrate can be of other materials, such as $LaAlO_3$, sapphire, $Al_2O_3$ or other ceramics.

The preferred embodiments of the present invention provide microstrip phase shifters, which include a tunable permittivity, low loss, bulk BST-based composite substrate.

Alternative electronically tunable ceramic material compositions can comprise at least one electronically tunable dielectric phase, such as barium strontium titanate, in combination with at least two additional metal oxide phases. Barium strontium titanate of the formula $Ba_xSr_{1-x}TiO_3$ is a preferred electronically tunable dielectric material due to its favorable tuning characteristics, low Curie temperatures and low microwave loss properties. In the formula $Ba_xSr_{1-x}TiO_3$, x can be any value from 0 to 1, and preferably from about 0.15 to about 0.6. More preferably, x is from 0.3 to 0.6.

Other electronically tunable dielectric materials may be used partially or entirely in place of barium strontium titanate. An example is $Ba_xCa_{1-x}TiO_3$, where x can vary from about 0.2 to about 0.8, and preferably from about 0.4 to about 0.6. Additional electronically tunable ferroelectrics include $Pb_xZr_{1-x}TiO_3$ (PZT) where x ranges from about 0.05 to about 0.4, lead lanthanum zirconium titanate (PLZT), lead titanate ($PbTiO_3$), barium calcium zirconium titanate ($BaCaZrTiO_3$), sodium nitrate ($NaNO_3$), $KNbO_3$, $LiNbO_3$, $LiTaO_3$, $PbNb_2O_6$, $PbTa_2O_6$, $KSr(NbO_3)$ and $NaBa_2(NbO_3)5\ KH_2PO_4$.

The phase shifter can also include electronically tunable materials having at least one metal silicate phase. The metal silicates may include metals from Group 2A of the Periodic Table, i.e., Be, Mg, Ca, Sr, Ba and Ra, preferably Mg, Ca, Sr and Ba. Preferred metal silicates include $Mg_2SiO_4$, $CaSiO_3$, $BaSiO_3$ and $SrSiO_3$. In addition to Group 2A metals, the present metal silicates may include metals from Group 1A, i.e., Li, Na, K, Rb, Cs and Fr, preferably Li, Na and K. For example, such metal silicates may include sodium silicates such as $Na_2SiO_3$ and $NaSiO_3$-$5H_2O$, and lithium-containing silicates such as $LiAlSiO_4$, $Li_2SiO_3$ and $Li_4SiO_4$. Metals from Groups 3A, 4A and some transition metals of the Periodic Table may also be suitable constituents of the metal silicate phase. Additional metal silicates may include $Al_2Si_2O_7$, $ZrSiO_4$, $KAlSi_3O_8$, $NaAlSi_3O_8$, $CaAl_2Si_2O_6$, $CaMgSi_2O_6$, $BaTiSi_3O_9$ and $Zn_2SiO_4$. Tunable dielectric materials identified as Parascan™ materials, are available from Paratek Microwave, Inc. The above tunable materials can be tuned at room temperature by controlling the electric field that is applied across the material.

In addition to the electronically tunable dielectric phase, the present electronically tunable materials can further include at least two additional metal oxide phases. The additional metal oxides may include metals from Group 2A of the Periodic Table, i.e., Mg, Ca, Sr, Ba, Be and Ra, preferably Mg, Ca, Sr and Ba. The additional metal oxides may also include metals from Group 1A, i.e., Li, Na, K, Rb, Cs and Fr, preferably Li, Na and K. Metals from other Groups of the Periodic Table may also be suitable constituents of the metal oxide phases. For example, refractory metals such as Ti, V, Cr, Mn, Zr, Nb, Mo, Hf, Ta and W may be used. Furthermore, metals such as Al, Si, Sn, Pb and Bi may be used. In addition, the metal oxide phases may comprise rare earth metals such as Sc, Y, La, Ce, Pr, Nd and the like.

The additional metal oxides may include, for example, zirconnates, silicates, titanates, aluminates, stannates, niobates, tantalates and rare earth oxides.

Preferred additional metal oxides include $Mg_2SiO_4$, MgO, $CaTiO_3$, $MgZrSrTiO_6$, $MgTiO_3$, $MgAl_2O_4$, $WO_3$, $SnTiO_4$, $ZrTiO_4$, $CaSiO_3$, $CaSnO_3$, $CaWO_4$, $CaZrO_3$, $MgTa_2O_6$, $MgZrO_3$, $MnO_2$, PbO, $Bi_2O_3$ and $La_2O_3$. Particularly preferred additional metal oxides include $Mg_2SiO_4$, MgO, $CaTiO_3$, $MgZrSrTiO_6$, $MgTiO_3$, $MgAl_2O_4$, $MgTa_2O_6$ and $MgZrO_3$.

The additional metal oxide phases are typically present in total amounts of from about 1 to about 80 weight percent of the material, preferably from about 3 to about 65 weight percent, and more preferably from about 5 to about 60 weight percent. In one embodiment, the additional metal oxides comprise from about 10 to about 50 total weight percent of the material. The individual amount of each additional metal oxide may be adjusted to provide the desired properties. Where two additional metal oxides are used, their weight ratios may vary, for example, from about 1:100 to about 100:1, typically from about 1:10 to about 10:1 or from about 1:5 to about 5:1. Although metal oxides in total amounts of from 1 to 80 weight percent are typically used, smaller additive amounts of from 0.01 to 1 weight percent may be used for some applications.

In another embodiment, the additional metal oxide phases may include at least two Mg-containing compounds. In addition to the multiple Mg-containing compounds, the material may optionally include Mg-free compounds, for example, oxides of metals selected from Si, Ca, Zr, Ti, Al and/or rare earths. In another embodiment, the additional metal oxide phases may include a single Mg-containing compound and at least one Mg-free compound, for example, oxides of metals selected from Si, Ca, Zr, Ti, Al and/or rare earths.

The tunability of the tunable dielectric material may be defined as the dielectric constant of the material with an applied voltage divided by the dielectric constant of the material with no applied voltage. Thus, the tunability percentage may be defined by the formula:

$$T=((X-Y)/X)\cdot 100;$$

where X is the dielectric constant with no voltage and Y is the dielectric constant with a specific applied voltage. High tunability is desirable for many applications. For example, in the case of waveguide-based devices, the higher tunability will allow for shorter electrical length, which means a lower insertion loss can be achieved in the overall device. Voltage tunable dielectric materials preferably exhibit a tunability of at least about 20 percent at 8V/micron, more preferably at least about 25 percent at 8V/micron. For example, the voltage tunable dielectric material may exhibit a tunability of from about 30 to about 75 percent or higher at 8V/micron.

In accordance with the present invention, the combination of tunable dielectric materials such as BSTO with additional metal oxides allows the materials to have high tunability, low insertion losses and tailorable dielectric properties, such that they can be used in microwave frequency applications. The materials demonstrate improved properties such as increased tuning, reduced loss tangents, reasonable dielectric constants for many microwave applications, stable voltage fatigue properties, higher breakdown levels than previous state of the art materials, and improved sintering characteristics. A particular advantage of the described materials is that tuning is dramatically increased compared with conventional low loss tunable dielectrics. A further advantage is that the materials may be used at room temperature. The electronically tunable materials may be provided in several manufacturable forms such as bulk ceramics, thick film dielectrics and thin film dielectrics.

The present invention relates generally to microstrip voltage-tuned phase shifters that operate at room temperature in the K and Ka bands. The devices utilize low loss tunable dielectric layers. In the preferred embodiments, the tunable dielectric layer is a Barium Strontium Titanate (BST) based composite ceramic, having a dielectric constant that can be varied by applying a DC bias voltage and can operate at room temperature.

While the invention has been described in terms of what are at present its preferred embodiments, it will be apparent to those skilled in the art that various changes can be made to the preferred embodiments without departing from the scope of the invention, which is defined by the claims. For example, to avoid the metal steps between the microstrip line and the matching circuits, in each of the embodiments, the first dielectric layer supporting the microstrip line could be sunk into the second dielectric layer, so as to ensure that the microstrip line is co-planar with the matching circuits.

What is claimed is:

1. A phase shifter comprising:

a substrate;

a first electrode positioned on a surface of the substrate;

a tunable dielectric layer positioned on a surface of the first electrode said tunable dielectric material operable at least at temperatures that include, room temperature and wherein the dielectric constant can be changed by 20% to 70% at 20 V/$\mu$m;

a microstrip positioned on a surface of the tunable dielectric layer opposite the substrate;

an input for coupling a radio frequency signal to the microstrip, the radio frequency signal in the K or Ka band;

an output for receiving the radio frequency signal from the microstrip; and a connection for applying a control voltage to the electrode.

2. A phase shifter according to claim 1, further comprising:

a second electrode positioned on the surface of the substrate, said first and second electrodes being separated to form a gap therebetween, the gap being wider than a width of said micro strip.

3. A phase shifter according to claim 1, further comprising:

a first impedance matching section coupling said input to said microstrip; and a second impedance matching section coupling said output to said microstrip.

4. A phase shifter according to claim 1, wherein the tunable dielectric layer comprises a material selected from the group of:

barium strontium titanate, barium calcium titanate, lead zirconium titanate, lead lanthanum zirconium titanate, lead titanate, barium calcium zirconium titanate, sodium nitrate, $KNbO_3$, $LiNbO_3$, $LiTaO_3$, $PbNb_2O_6$, $PbTa_2O_6$, $KSr(NbO_3)$, $NaBa_2(NbO_3)_5$, $KH_2PO_4$, and combinations thereof.

5. A phase shifter according to claim 1, wherein the tunable dielectric layer comprises a barium strontium titanate (BSTO) composite selected from the group of:

BSTO—MgO, BSTO—$MgAl_2O_4$, BSTO—$CaTiO_3$, BSTO—$MgTiO_3$, BSTO—$MgSrZrTiO_6$, and combinations thereof.

6. A phase shifter according to claim 1, wherein the tunable dielectric layer comprises a material selected from the group of:

$Mg_2SiO_4$, $CaSiO_3$, $BaSiO_3$, $SrSiO_3$, $Na_2SiO_3$, $NaSiO_3$-$5H_2O$, $LiAlSiO_4$, $Li_2SiO_3$, $Li_4SiO_4$, $Al_2Si_2O_7$, $ZrSiO_4$, $KAlSi_3O_8$, $NaAlSi_3O_8$, $CaAl_2SiO_8$, $CaMgSi_2O_6$, $BaTiSi_3O_9$ and $Zn_2SiO_4$.

7. A phase shifter according to claim 1, wherein the tunable dielectric layer comprises an electrically tunable phase and at least two metal oxide phases.

8. A phase shifter according to claim 1, wherein the substrate comprises a material selected from the group of:

MgO, $LaAlO_3$, sapphire, $Al_2O_3$, and a ceramic.

* * * * *